United States Patent [19]

Mathiolon et al.

[11] 4,175,717

[45] Nov. 27, 1979

[54] OVERHEAD CREEL FOR TWISTING MACHINES

[76] Inventors: Henri Mathiolon, 18 Rue de Tourvielle, 69005 Lyon; Simon Charbonnier, 10 Rue Louis Thevenet, 69004 Lyon, both of France

[21] Appl. No.: 898,594

[22] Filed: Apr. 21, 1978

[30] Foreign Application Priority Data

Mar. 2, 1978 [FR] France ..... 78 06589

[51] Int. Cl.[2] ..... B65H 49/02

[52] U.S. Cl. ..... 242/131

[58] Field of Search ..... 242/131, 131.1; 66/125 R

[56] References Cited

U.S. PATENT DOCUMENTS

| | | | |
|---|---|---|---|
| 1,712,059 | 5/1929 | Trevett | 242/131 |
| 3,168,996 | 2/1965 | Vossen | 242/131 |
| 3,674,223 | 7/1972 | Philip | 242/131 |

*Primary Examiner*—Leonard D. Christian

*Attorney, Agent, or Firm*—Dowell and Dowell

[57] ABSTRACT

A continuously twisting or doubling machine of the type comprising a bobbin holder or creel linked to the frame of the machine so as to take two positions: an operating position and a loading position respectively, the creel or bobbin holder comprising a latch for locking it automatically in either one of the two positions and the latch being such as to permit automatic unlocking of the creel or bobbin holder merely by moving it without any direct manipulation of the members of the latch.

10 Claims, 10 Drawing Figures

37
34
F
39
25
24
39a
30d
31
30c
36
35d
33b
35
30a
35f
35a
23
35b
38a
33
35e
33a
35c
38
33c
32
30
30b
F
F
F1
30a
31
35"
35e
38a
35'
38
35f
30
36
35d
35b
35
35a
35c
33b
35e
32
33c
24
30c
33
30d
33a
32
30b

OVERHEAD CREEL FOR TWISTING MACHINES

The present invention relates to improvements in bobbin holders or creels to be used more particularly but not exclusively with continuously operating twisting machines.

In machines of that type, as is well known, a thread from a bobbin mounted on the usual spindle is twisted together with at least one other thread from at least one other bobbin installed on a bobbin holder or creel independent of the spindle. For faciliting operation the creel comprises two bobbins having threads connected together.

It is clearly seen that when the creel is placed above the machine it lies at a height of about two meters above the floor, so that the person in charge of the remplacement of bobbins must climb on a footstool, a step-ladder or the like. This working step implies that one runs the risk of falling off the stool; it results into significant loss of time and finally, the operator should handle heavy enough loads at arm's length.

Creels disposed close to twisting machines are also known. They obviously often interfere with the circulation around the machines, the more so because the threads must find their way between the machines and the creel.

It has already been proposed, for instance in French Pat. No. 1 192 773, to make a bobbin holder pivoting about a horizontal shaft to facilitate the loading of bobbins, i.e. to make them more accessible to the operator. Obviously, such device can of course be transferred into a twisting machine to avoid said drawbacks of the stationary creels disposed above, or close to, twisting machines.

In order that the operators can work more easily, the movements applied to the creel must as much as possible be performed by one hand only. Moreover, the two end positions of the creel must necessarily be provided with an automatic locking mechanism.

According to the invention, the movable bobbin holder or creel associated to a twisting machine comprises means for locking it automatically at its two positions, said means permitting automatic unlocking of the bobbin holder or creel by simply moving it without any direct action upon any members of said locking means.

The invention will be best understood from the description which follows and from the accompanying drawings, with description and drawings, given particularly by way of indication, which will also make apparent other advantages and objectives and also the important characteristics of the invention, of which the main ones are also defined in the accompanying claims.

Figure 1:
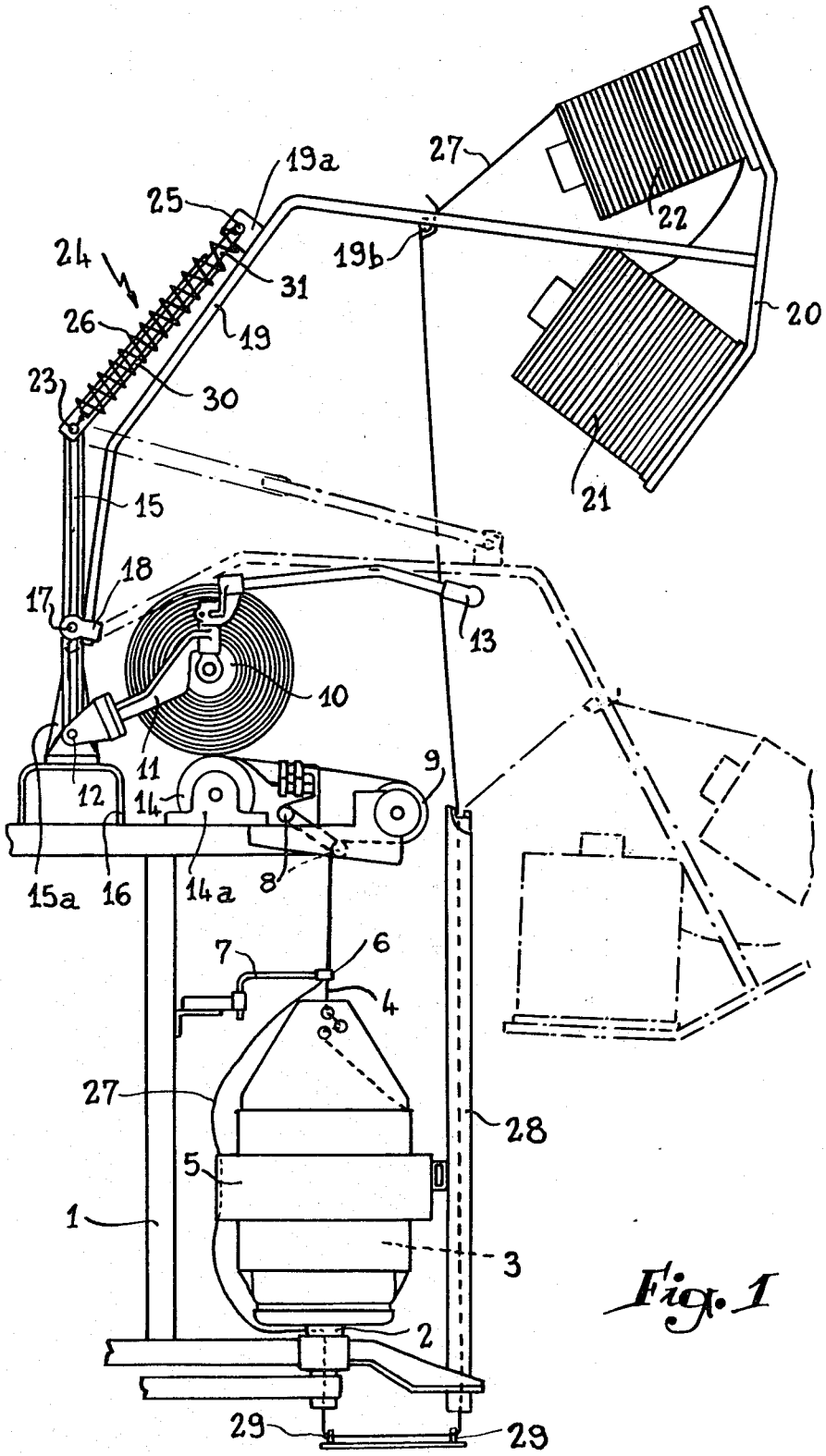
FIG. 1 is a side view of a twisting machine on which there is mounted a creel comprising the improvements according to the invention.

FIG. 1 shows a twisting machine comprising a frame 1 carrying a rotatably mounted hollow spindle 2 supporting a bobbin 3 from which a first thread 4 is drawn. In a known way, the bobbin is surrounded by a peripheral deflector 5. The thread 4 passes through an eyelet 6 fixed at the end of a bar 7 secured to frame 1. This thread goes then around a series of rollers 8 and a pulley 9 to come to wind itself in the usual way on a drum 10, said drum being carried by two arms 11 pivoted about a shaft 12. One of the arms 11 is associated to an actuation lever 13 which allows the drum 10 to be lifted with respect to a cylinder 14 mounted idle on bearings **14*a* secured to the frame 1**.

It will be noted that shaft 12 is carried by the base **15*a* of a vertical pillar 15, said base lying on a support 16 fixed to the frame 1. Pillar 15 supports a horizontal shaft 17 which protrudes on both sides of the pillar so as to provide a pivot for a bracket 18 connected to a mast 19 extending in a broken line. The mast 19 comprises three successive sections directed obliquely with respect to one another, the end of the last section being associated to a plate 20 for supporting in a manner known per se, not shown, two bobbins of thread 21, 22**.

On the upper free portion of the pillar 15 there is pivoted through a shaft 23 one end of a locking mechanism 24, whereas the other end is hinged to a lug **19*a* on the mast 19 through an axle 25. A tension spring 26 is mounted around device 24, each of its ends being hooked to axles 23 and 25** respectively.

The mast 19 also comprises an eyelet **19*b* into which there is threaded a thread 27 from bobbin 22, which passes through a vertical tube 28 fixed to the frame 1 and then runs through a double thread-guide 29 to end in eyelet 6 after passage in spindle 2 which it leaves laterally in the usual way. It will be noted that the thread 27 lies within deflector 5. Threads 27 and 4 are thereafter twisted owing to circular motion of the first about bobbin 3** as is well known in the art.

Due to the pivoting of the mast about the shaft 17 the bobbins can be brought to the lower loading position as shown in dotted lines in FIG. 1.

Figures 2, 3:
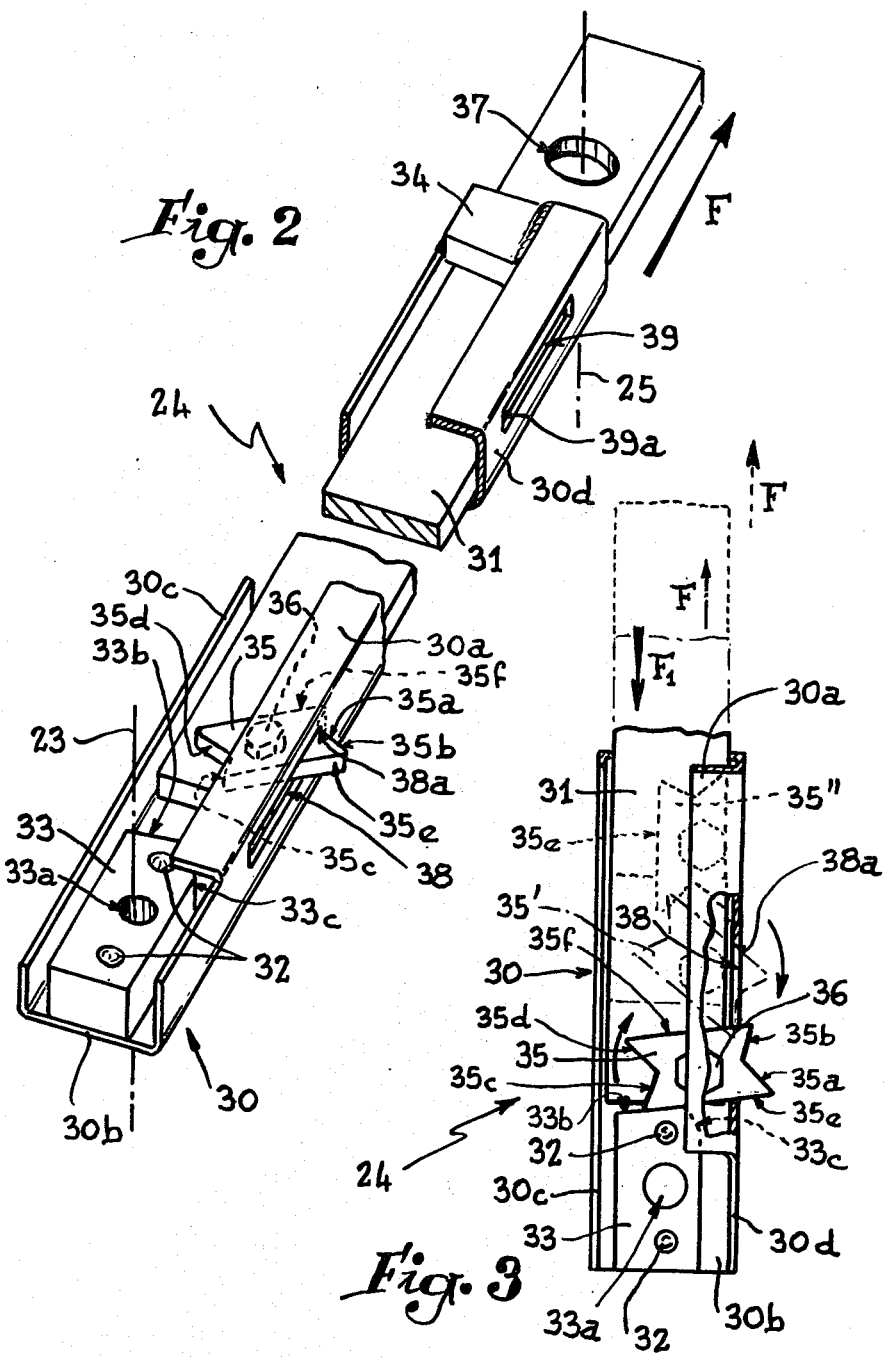
FIG. 2 is a perspective view of the locking mechanism used for positioning the creel.
FIGS. 3 to 6 illustrate the operation of the device shown in FIG. 2.

The locking device 24 illustrated in FIG. 2 comprises two main elements forming a channel 30 in which a slide 31 in the form of a flat iron can move axially. The channel has a U-shaped cross section, with the end of one leg thereof being prolonged into a wall **30*a* parallel to its base 30*b* but of a smaller width. One end of the wall 30*a* terminates before reaching the respective end of the remaining portion of the channel so as to provide access to rivets 32 for fixing a backing 33 within the channel. The backing is formed with a hole 33*a* for allowing passage of shaft 23. The opposite end of the channel 30 is made with a block 34 welding between the inside of wing 30*c* of the channel and the respective edge of wall 30*a*. The distance between the inner face of the bottom 30*b* of the channel and the opposite face of block 34 is such as to correspond, except for the play, to the thickness of the slide 31. As shown, the backing 33 extends for the entire height of the channel. The slide 31 carries a catch 35 hinged about an axis 36 in the form of a screw, on one of its side portions and on a level with its inner end within the channel. At the other end of the slide 31 there is a hole 37 for permitting passage of axis 25. The wing 30*d* of the channel is formed with two slots 38, 39 lying in the plane of the catch 35** and the function of which will be explained later. The catch is of a generally rectangular form with its two smaller sides extending in broken lines having a reentrant angle each defining a recess having edges designated as 35*a* to 35*d*. The slopes of edges 35*a*, 35*b*, respectively, 35*c*, 35*d*, are different so as to delimit two diagonally opposed vertices more prominent than the two others and which are defined by cooperation of edges 35*a*, 35*d*, respectively, with longitudinal faces 35*e*, 35*f*. Obviously, the inner height of the channel is slightly larger than the total thickness of slide 31 and catch 35 so as to allow the latter to pivot freely about its axis 36.

Assuming that device 24 is in its retracted position corresponding to the operative position, namely, when the bobbins are in the higher position, it can be seen in FIG. 2 that the recess at the junction of inclined edges 35*a*, 35*b* of the catch lies at the end 38*a* of slot 38 due to the weight of the bobbins exerting upon the slide 31 a force applied in the direction of the arrow F.

In order to lower mast 19 or the creel it is required to lift the latter further so as to release catch 35 with respect to the end 38*a* of the slot 38. This motion causes the slide 31 to move in the direction of arrows F1, FIG. 3, until catch 35 bears by one of its side faces against the inner edge 33*b* of backing 33 by turning clockwise as shown in FIG. 3. The motion is then reversed, without releasing the mast 19, so as to bring it down. This action causes the slide 31 to move in the direction of arrow F. The side face 35*f* of the catch opposite to face 35*e* comes into abutment with the end 38*a* of slot 38 so that its clockwise rotation continues as at 35' in FIG. 3, to be eventually oriented parallel to the direction of movement as shown by the discontinuous line with reference 35" in FIG. 3.

Figure 4:
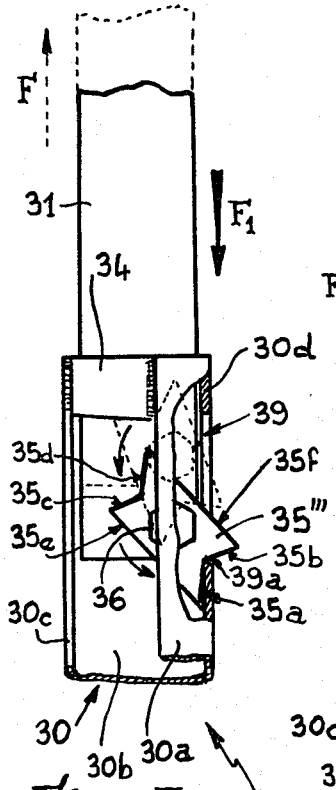

At the end of the motion, i.e. in the lowermost position of mast 19, the inclinded edge 35*c* of the catch comes into abutment with the block 34. Due to the inclination of the edge 35*c* the catch runs slightly in the anti-clockwise direction as shown in FIG. 4 from which it is clear that in such a position the vertex of the catch corresponding to edge 35*b* lies outside of the channel 30 i.e. edge 35*d* stands out of the respective slot 39. Then the creel is raised due to the biasing action of the spring so that the slide 31 moves again in the direction of arrow F1 thereby causing the recess at the junction at the edges 35*a* and 35*b* of the catch to cooperate with the end 39*a* of slot 39 as shown by the referenced position 35'''. Therefore positive stop is obtained under the action of the spring; it is the load locking position.

Figure 5:
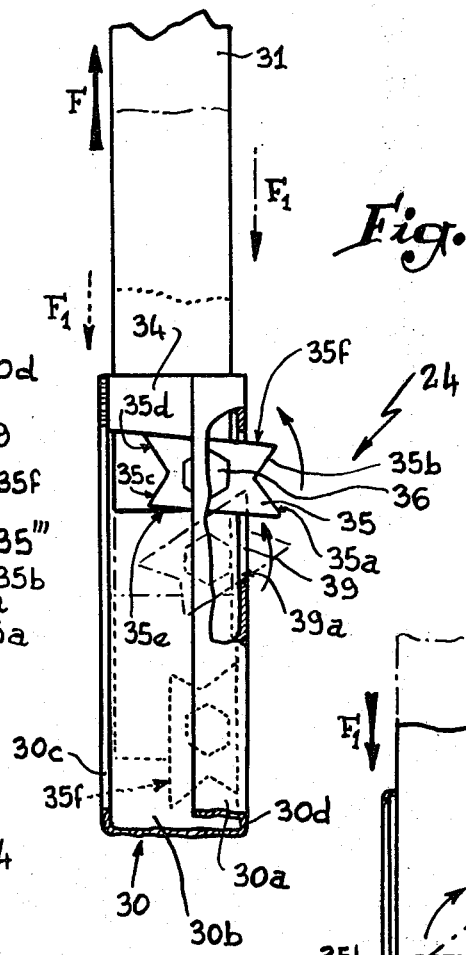
Figure 6:
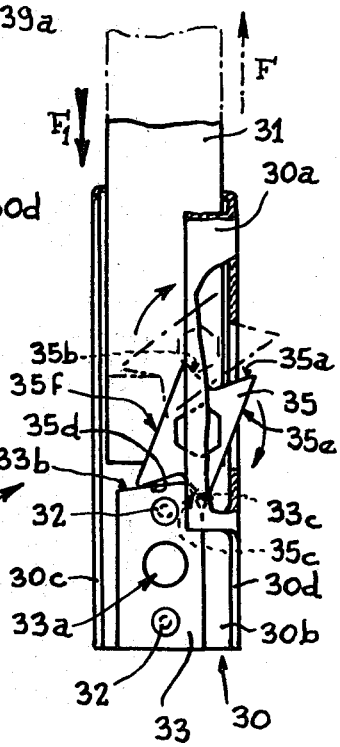

In order to raise the creel to its operating position the mast 19 must be lowered against the action of the spring so that the face 35*f* of the catch comes into abutment with the inner edge of block 34 (FIG. 5) whereby the catch is caused to turn in the anti-clockwise direction. After a slight move the motion in question is stopped and the mast 19 or the creel generally is moved in the other way round to raise the creel in such a way that the slide 31 moves again in the direction of the arrow F1 with respect to the channel 30. The other larger side 35*e* of catch 35 abuts against the end 39*a* of the slot 39 so that pivoting of the catch in the anti-clockwise direction continues until it is oriented axially in respect to the channel. At the end of the upward movement the catch turns in the clockwise direction as shown in FIG. 6 through cooperation of its prominent vertex as determined by edge 35*d* with the edge 33*b* disconnected from backing 33. In view of the slope of the tip 33*c* of edge 33*b* the vertex of the catch corresponding to edge 35*e* can be passed. The vertex of the catch corresponding to its edge 35*a* stands out of the slot 38 so that when the mast 19 is released it becomes locked by cooperation of the junction of edges 35*a* and 35*b* with the end 38*a* of slot 38 (FIGS. 5 and 2). It is easily understood that the purpose of spring 26 is to facilitate the upward movement to the higher position of the mast 19, to attenuate its downward movement and to lock it in the lower position. Obviously, because of the difference in the size of the vertices of the catch the end 33*b* of the backing 33 might without any inconvenience extend transversely without any recess being formed therein.

It is to be voted that the locking device 24 works automatically both in the locked and the unlocked positions without any action upon a member other than the creel itself so that all actuations thereof can take place by means of one hand only.

Figure 7:
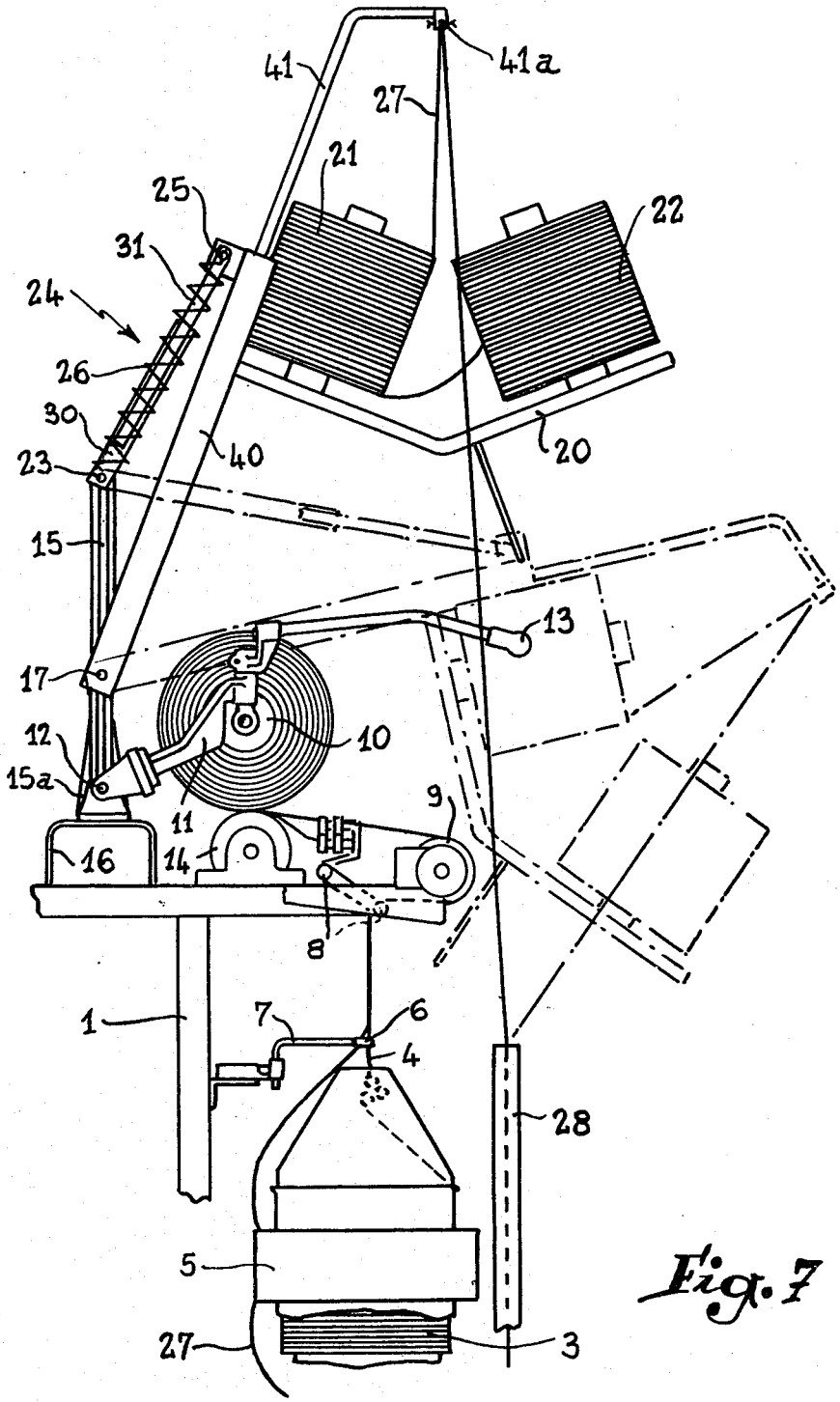
FIG. 7 is a view which shows another form of embodiment of the creel shown in FIG. 1.

FIG. 7 shows a preferred form of embodiment of the invention in which the mast 19 is a shaped element 40 which extends into a bent bar 41, the end of which carries an eyelet 41*a*, with the plate 20 for the bobbins 21, 22 being connected to the shaped element. In this form of embodiment the symmetrical plane of the bobbins 21, 22 lies vertically thereby facilitating extracting of the thread from either one of the bobbins in the direction of the eyelet 41*a*.

Figure 8:
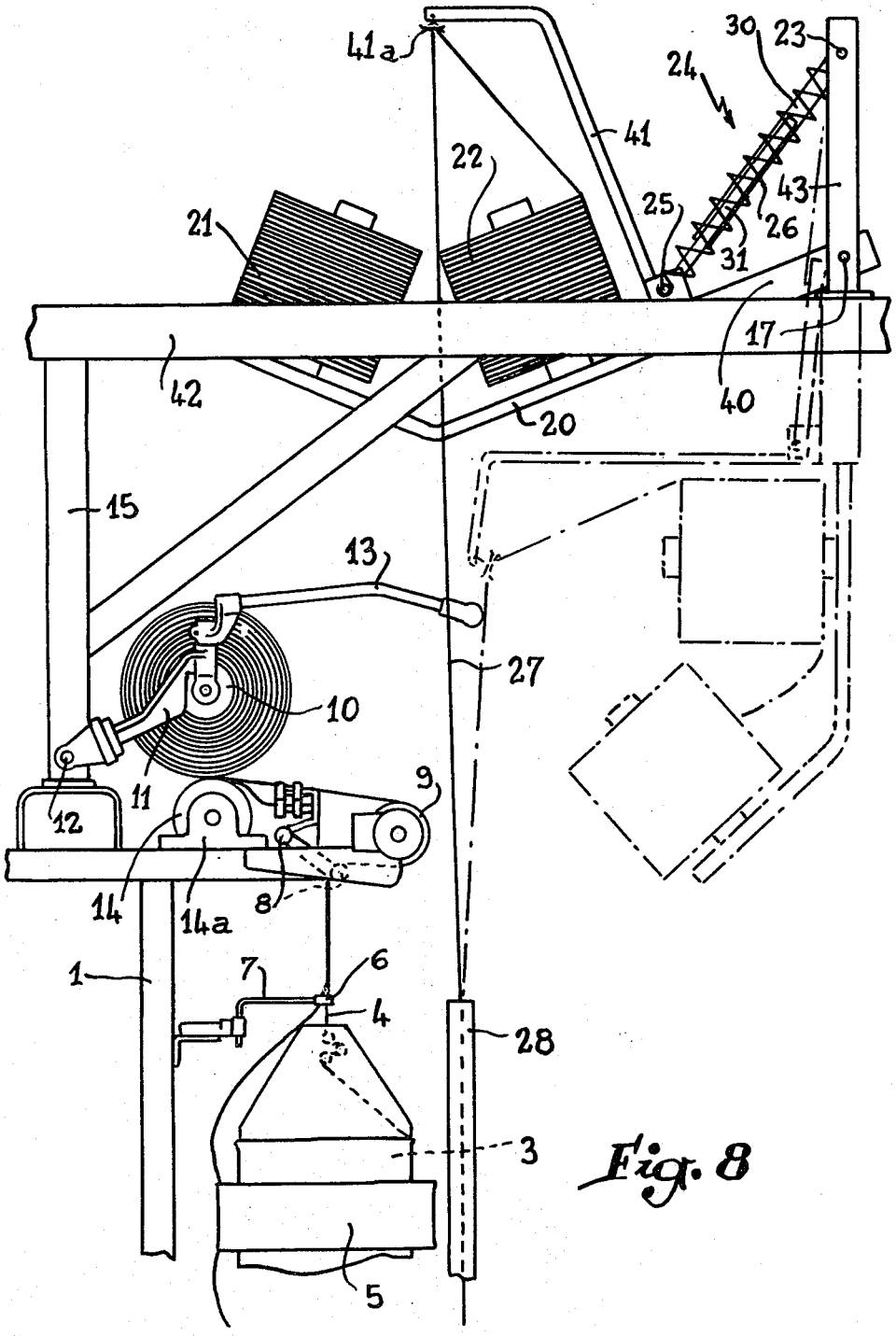
FIG. 8 is a view which shows another way of mounting the creel according to the invention.

As shown in FIG. 8 the mast 40–41 could be hinged with respect to a stationary cross-beam 42 disposed above the frame 1 and which can rest on another machine placed opposite or behind the first. The cross-beam 42 comprises a profiled column 43 supporting the axes 17 and 23 of articulation of mast 40 and the locking device 24 respectively.

Figure 9:
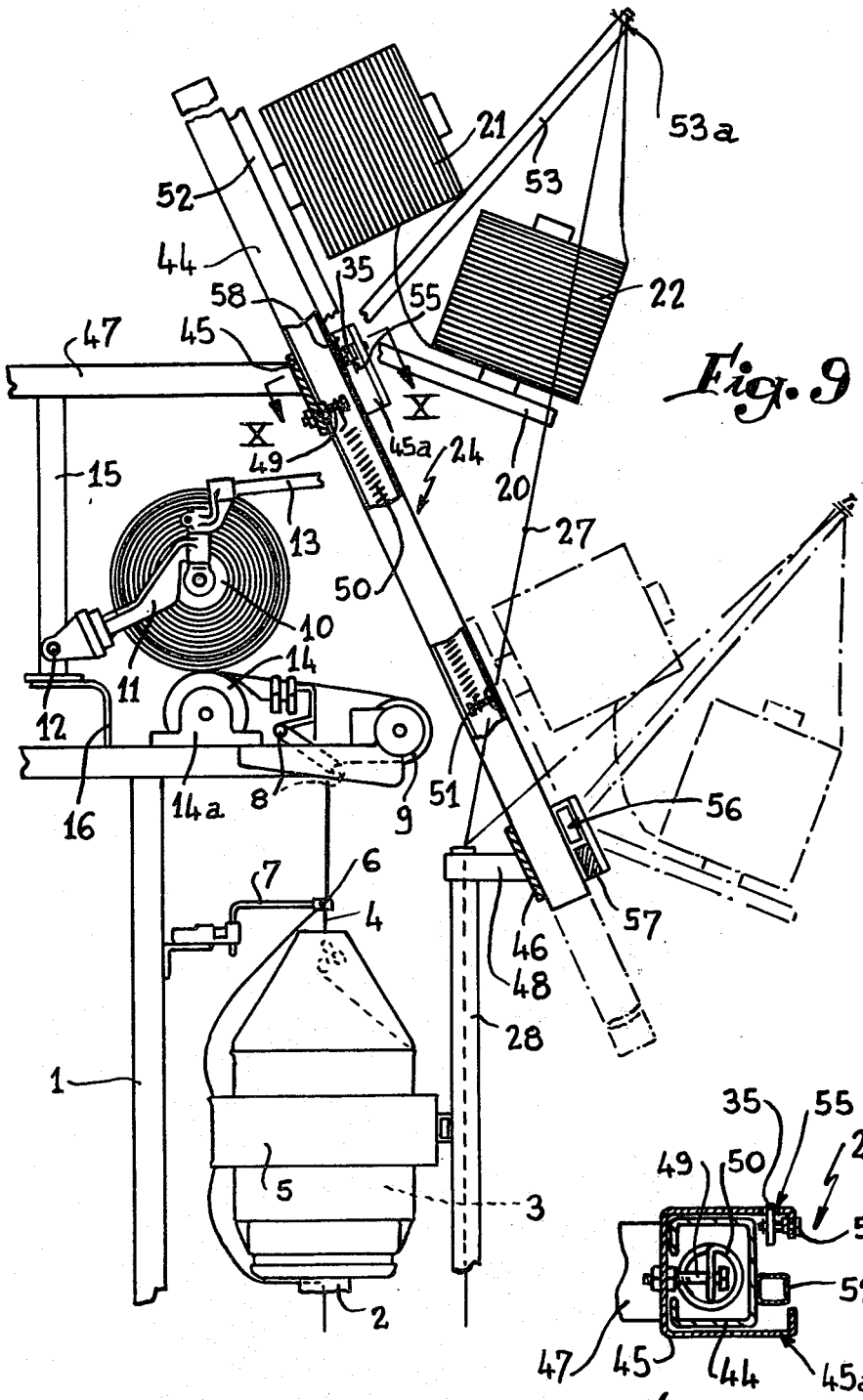
FIG. 9 is a view similar to FIG. 1 but showing another embodiment.
Figure 10:
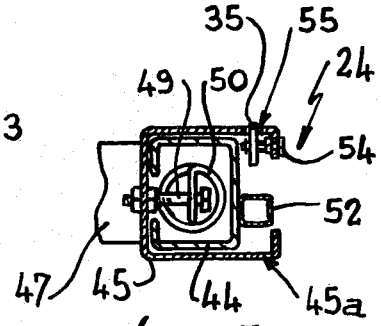
FIG. 10 is a sectional view thereof taken on line 10—10 (FIG. 9).

FIG. 9 illustrates another form of embodiment wherein the motion of plate 20 does not take place by means of a pivotal mast but rather along a column 44 made from an open profiled tubular as shown in FIG. 10. This column is slidingly mounted with respect to the frame 1 through two outer sleeves 45, 46 connected to arms 47, 48 secured to pillar 15 and tube 28 respectively. The sleeve 45 has a connection 49 to which the one end of a tension spring 50 is hooked whereas the other end is secured to column 44 through a bolt 51. Thus, the spring bias exerts an upwardly directed force upon column 44. Adjusting means not shown can be provided for allowing the column 44 to glide freely with reduced play with respect to the sleeve 45, 46.

Column 44 is attached to a longitudinal tubular profiled member 52 which constitutes a base for the plate 20 of the bobbin support. This plate comprises an inclined arm 53 carrying at its free end an eyelet 53*a* intended for the passage of the thread 27 from the bobbin 22, which travels through the tube 28 as described above in reference to FIG. 1. In this form of embodiment a locking device 24 as described above is used; the end of the slide 31 thereof cooperates with a bolt 54 connected to the sleeve 45, whereas its channel 30 is secured to the column 44. According to a preferred form of embodiment, the channel is made by the laterally projecting portion 45*a* of each of sleeves 45, 46 which are formed with elongated orifices 55, 56 corresponding to slots 38, 39. The backing 33 is composed of a bushing 57 connected to the sleeve 46 and the block 34 is in the form of an abutment 58. The catch is then hinged laterally with respect to the column 44 so that it can pivot freely to cooperate with the orifices in the sleeves as well as with the bushing 57 and the abutment 58, as mentioned above with reference to FIGS. 2 to 6.

The plate 20 moves then obliquely rather than in a circular motion, but the same purpose is served, namely, readily replacing the bobbins 21, 22 in the lower position as shown in the drawing by mixed lines.

Furthermore, it has to be understood that the foregoing description has only been given by way of example and that it does not in any way limit the scope of the invention, from which there would be no departure if the constructional details as described are replaced by any other equivalents.

We claim:

1. A creel for supporting bobbins on a continuous thread twisting machine of the type having a frame and a twisting spindle, the creel comprising:

a bobbin holder plate;

plate support means mounted on the frame of the machine and supporting the plate, the support means being moveable between an operating position in which the bobbin holder plate is elevated above the spindle, and a loading position in which the bobbin holder is lowered to approach the level of the spindle; and means for locking the plate support means selectively in said operating position or in said loading position, said locking means comprising telescoping slide elements respectively connected to the frame of the machine and to the plate support means, and releasable catch means connected to the slide elements and automatically engaging when the plate support means reaches either one of the positions to latch the slide elements to prevent movement of the plate support means toward the other position.

2. A creel as claimed in claim 1, wherein said telescoping slide elements comprise a channel element and a slide bar element slidable inside the channel element, the slide bar element rotatably supporting said catch means, the channel element having two spaced slots therethrough and having spaced abutments near the slots for limiting the telescoping movement of the elements and for deflecting the catch means to engage and latch in a slot when the slide bar element approaches one of said positions.

3. A creel as claimed in claim 2, wherein said channel element is U-shaped and has wing means extending over the slide bar element parallel to the bottom of the channel element to maintain the slide bar element therein.

4. A creel as claimed in claim 2, wherein said abutments comprise a first block substantially closing one end of the channel element, and a second block overlying and slidably confining the slide bar element near the other end of the channel element.

5. A creel as claimed in claim 2, wherein said locking means further comprises a spring operative to urge said telescoping elements to telescope in a direction such that when the plate support means is in the lowered loading position the spring means urges it upwardly, the plate support means being urged downwardly by gravity when it is in the elevated operating position, and wherein the catch means is an elongated member centrally pivoted to said slide bar element and having two vertices at each of its ends defining a recess therebetween at each end for latching in one of said slots in the channel element when the catch means is deflected theretoward by an abutment.

6. A creel as claimed in claim 5, wherein each of said abutments has a surface facing toward the catch means and beveled and located so that it engages one of the vertices at one end of the catch means to deflect the catch means for latching at its other end in a slot when the plate support means is moved into a new one of said positions, and so that the abutment surface engages the other of said vertices at said one end of the catch means to deflect the catch means away from latching in the slot when the plate support means is moved beyond said one position away from the other position.

7. A creel as claimed in claim 1, wherein the plate support means comprises a mast pivotally connected to the frame at one end for rotation in a vertical plane and supporting the bobbin holder plate at its other end, and one of said telescoping elements being pivotally connected to said frame and the other of said telescoping elements being pivotally connected to the mast between its ends.

8. A creel as claimed in claim 1, wherein the plate support means comprises a column disposed obliquely across the splindle from a position thereabove, sleeve means fixed to the frame and slidably guiding said column, the column supporting the bobbin holder plate, and the locking means being connected between the sleeve means and the column.

9. A creel as claimed in claim 8, wherein the column and the sleeve means are channel shaped and are telescopically interfitted and comprise said telescoping slide elements.

10. A creel as claimed in claim 9, further comprising tension spring means within the column and connected between the columm and the sleeve means, the spring means being operative when the plate support means is in said lowered loading position to urge the column upwardly.

* * * * *